US006922882B2

(12) United States Patent
Shah et al.

(10) Patent No.: US 6,922,882 B2
(45) Date of Patent: Aug. 2, 2005

(54) METHOD OF JOINING TUBULAR MEMBERS

(75) Inventors: Sanjay Mahasukhlal Shah, Troy, MI (US); Joseph M. Lendway, IV, Dryden, MI (US); Charles J. Bruggemann, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/440,808

(22) Filed: May 19, 2003

(65) Prior Publication Data

US 2004/0231125 A1 Nov. 25, 2004

(51) Int. Cl.[7] ..... B23P 17/00

(52) U.S. Cl. ..... 29/421.1; 29/447; 29/507; 72/58; 72/61

(58) Field of Search ..... 29/421.1, 446, 29/447, 450, 453, 469.5, 505, 507, 508, 510, 515, 516; 72/58, 61

(56) References Cited

U.S. PATENT DOCUMENTS 2,992,479 A * 7/1961 Walton et al. ..... 29/421.1
3,208,136 A * 9/1965 Joslin ..... 29/458
3,210,102 A * 10/1965 Joslin ..... 285/374
3,579,805 A * 5/1971 Kast ..... 148/529
4,759,111 A * 7/1988 Cudini ..... 29/523
5,170,557 A * 12/1992 Rigsby ..... 29/890.08
5,333,775 A * 8/1994 Bruggemann et al. ..... 228/157
5,720,092 A * 2/1998 Ni et al. ..... 29/421.1
6,183,013 B1 * 2/2001 Mackenzie et al. ..... 280/797
6,460,250 B1 * 10/2002 Amborn et al. ..... 29/897.2
6,474,534 B2 * 11/2002 Gabbianelli et al. ..... 228/131
6,484,384 B1 * 11/2002 Gibson et al. ..... 29/516
6,609,301 B1 * 8/2003 Morris et al. ..... 29/897.1
6,654,995 B1 * 12/2003 Wang et al. ..... 29/421.1
6,701,598 B2 * 3/2004 Chen et al. ..... 29/421.1
6,742,258 B2 * 6/2004 Tarbutton et al. ..... 29/897
6,842,956 B1 * 1/2005 Amborn et al. ..... 29/421.1
6,848,725 B2 * 2/2005 Logan et al. ..... 285/382
2003/0204944 A1 * 11/2003 Norek ..... 29/421.1

OTHER PUBLICATIONS

Co–pending U.S. Appl. No. 10/125,947, issued Apr. 19, 2002.

* cited by examiner

*Primary Examiner*—Essama Omgba
(74) *Attorney, Agent, or Firm*—Laura C. Hargitt

(57) ABSTRACT

A method of joining tubular members together includes the steps of providing an internal tubular member, providing an external tubular member, and heating the external tubular member and/or cooling the internal tubular member. The method also includes the steps of joining the internal tubular member and second tubular member together to form an overlap region of a joined tubular member, and positioning the joined tubular member between open die halves mating with one another to define a tubular cavity portion. The method includes the steps of progressively closing the die halves to progressively deform the joined tubular member within the tubular cavity portion. The method includes the steps of applying hydraulic pressure to expand and conform the joined tubular member to the tubular cavity portion. The method also includes the steps of separating the die halves and removing the expanded joined tubular member from the die.

5 Claims, 3 Drawing Sheets

METHOD OF JOINING TUBULAR MEMBERS

TECHNICAL FIELD

The present invention relates generally to forming a shaped tubular member and, more particularly, to a method of joining tubular members of hydroformed metal tubing for assembling automotive structures.

BACKGROUND OF THE INVENTION

It is known to hydroform tubular components. Hydroformed tubular components are becoming increasingly popular in automotive body structural applications. During vehicle body manufacturing, methods for hydroforming relatively simple frame structures have been performed. One method for producing a frame structure includes the steps of pre-assembling an initial frame having a plurality of cylindrical metal tubes interconnected by the insertion of the ends of the cylindrical tubes onto mating pre-formed hollow metal nodal joints at substantially uniform circular interfaces. The method also includes the steps of securely joining the tubes and nodal joints by welding at the circular interfaces. The method includes the steps of placing the entire initial frame between a single set of hydroforming dies having mating cavities accommodating the tubes and joints and providing, when closed, a single cavity having a cross-sectional shape matching the cross-sectional shape desired for the completed frame structure. The method further includes the steps of pressurizing the entire interior of the initial frame to expand all of the tubes and joints out into the single cavity concurrently to complete the frame structure.

However, these joints require welding and/or adhesive bonding. During welding, dimensional distortion of the tubular members may occur, which is undesired. In addition, the welding process may cause joint corrosion. Further, only similar metals may be used in the welding process. Additionally, the welding and bonding are time consuming processes for assembly.

As a result, it is desirable to provide a new method of joining tubular members together to form a joint therebetween. It is also desirable to provide a method of joining tubular members together without welding or adhesive bonding. It is further desirable to provide a method of joining tubular members together that is faster than welding or adhesive bonding. Therefore, there is a need in the art to provide a method of joining tubular members that meets these desires.

SUMMARY OF THE INVENTION

It is, therefore, one object of the present invention to provide a new method of joining tubular members together.

It is another object of the present invention to provide a method of joining tubular members together to form a joint therebetween.

To achieve the foregoing objects, the present invention is a method of joining tubular members together. The method includes the steps of providing an internal tubular member and an external tubular member. The method also includes the steps of heating or cooling either one of the first tubular member and the second tubular member and joining the first tubular and second tubular members together to form an overlap region of a joined tubular member. The method includes the steps of positioning the joined tubular member between open die halves mating with one another to define a tubular cavity portion. The method further includes the steps of progressively closing the die halves to progressively deform the joined tubular member within the tubular cavity portion. The method includes the steps of applying hydraulic pressure to expand and conform the joined tubular member to the tubular cavity portion. The method also includes the steps of separating the die halves and removing the joined tubular member from the die.

One advantage of the present invention is that a method of joining tubular members together to form a joint therebetween is provided for a vehicle, eliminating welding of the tubular members. Another advantage of the present invention is that the method allows a thermal interference fit tubular joint, to assemble hydroframe structures. Yet another advantage of the present invention is that the method allows easier and faster assembly of tubular members by eliminating welding and adhesive bonding. Still another advantage of the present invention is that the method eliminates joint corrosion and dimensional distortion caused by welding. A further advantage of the present invention is that the method allows dissimilar metals (e.g., aluminum to steel) to be assembled.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
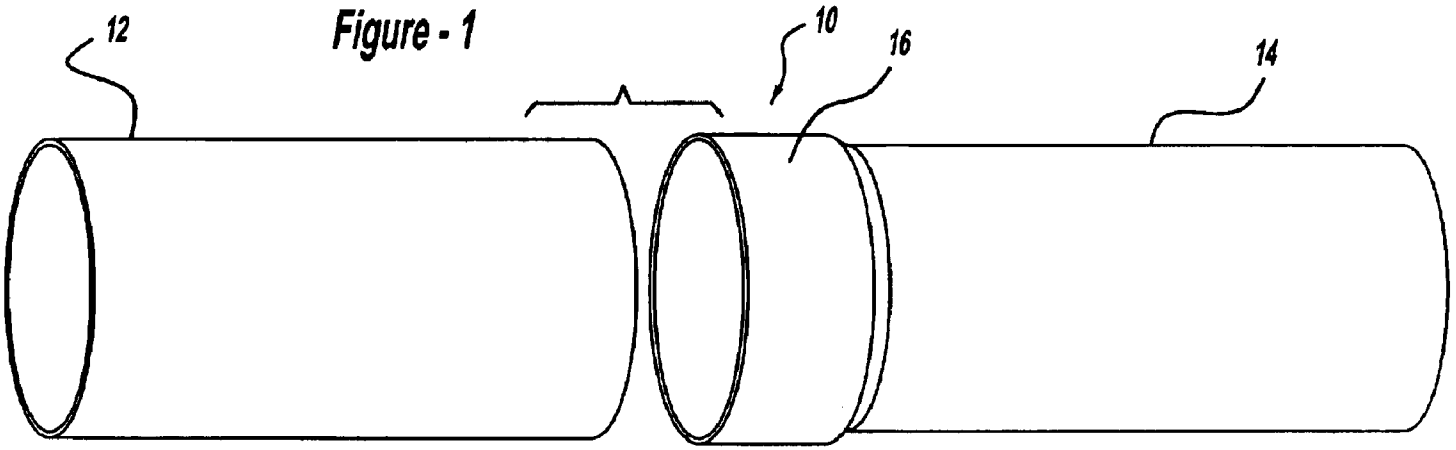
FIG. 1 is an exploded perspective view of a method, according to the present invention, for joining tubular members.
Figure 2:
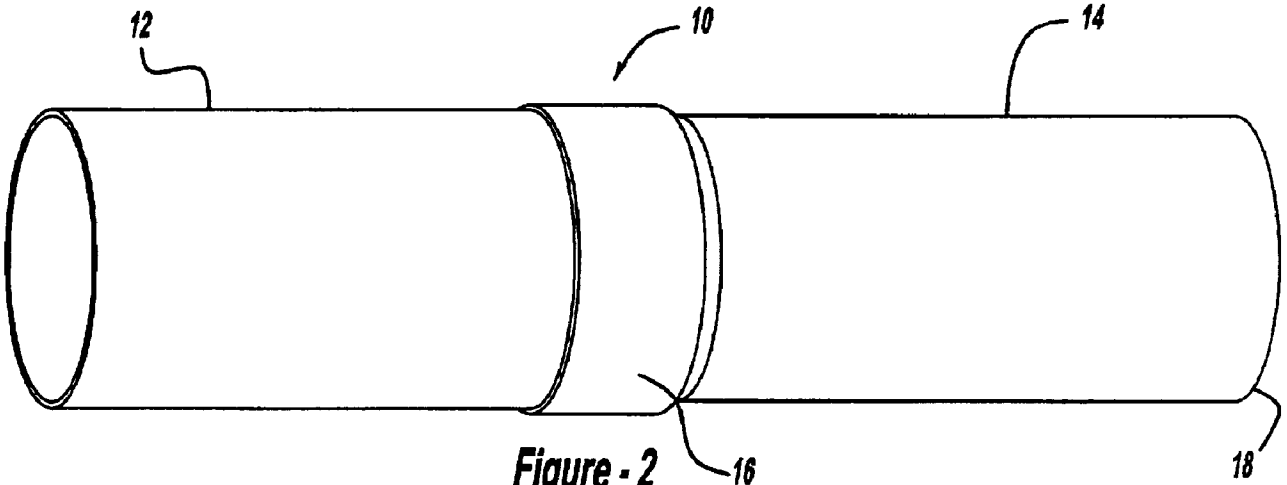
FIG. 2 is a perspective view of the joined tubular members of FIG. 1.

Referring to the drawings and in particular FIGS. 1 and 2, one embodiment of a joint 10, according to the present invention, for tubular blank or members 12 and 14 is shown for use in carrying out a method, according to the present invention, of joining the tubular members 12 and 14 with the joint 10 therebetween for assembly in automotive structures (not shown). The method includes the step of providing an internal tubular member 12 and an external tubular member 14. The internal and external tubular members 12 and 14 are made of a metal material. In one embodiment, the internal tubular member 12 has a generally circular cross-sectional shape and extends axially and the external tubular member 14 has a generally circular cross-sectional shape and extends axially. The external tubular member 14 has a flange or integral expansion or expanded region 16 at one end extending radially and axially to receive and overlap a portion of the internal tubular member 12 when the internal and external tubular members 12 and 14 are joined by the method, according to the present invention. It should be appreciated that, at ambient temperature, the internal tubular member 12 and external tubular member 14 form an interference fit. It should also be appreciated that the joint 10 is an overlapping tube joint.

In one embodiment, the method includes the step of cooling the internal tubular member 12 to a temperature less than the external tubular member 14. In another embodiment, the method includes the step of heating the external tubular member 14 to a temperature greater than the internal tubular member 12. In yet another embodiment, the method includes the step of cooling the internal tubular member 12 and heating the external tubular member 14. It should be appreciated that for the joint 10, the internal tubular member 12 is cooled or the external tubular member 14 is heated, or both, to allow an interference fit between the inside diameter of the flange or integral expansion or expanded region 16 of the external tubular member 14 and the outside diameter of the internal tubular member 12.

After the external tubular member 14 is sufficiently heated up and/or the internal tubular member 12 is sufficiently cooled, the method includes the step of positioning the internal tubular member 12 inside the flange or integral expansion or expanded region 16 of the external tubular member 14 and forming an overlap region or the joint 10. The method includes the step of cooling the tubular members 12 and 14 to ambient temperature and forming a tightly sealed tube joint 10. It should be appreciated that the joined tubular member 18, as illustrated, has the same diameter circular cross-section throughout its length, except for the joint 10. It should also be appreciated that an optimum diameter of the joined tubular member 18 is selected based on manufacturing and product needs.

Referring to FIG. 2, the joined tubular product or member 18 is shown. The joined tubular member 18 is integral and one-piece. It should be appreciated that the joined tubular member 18 is hydroformed in a manner to be described.

Figure 5:
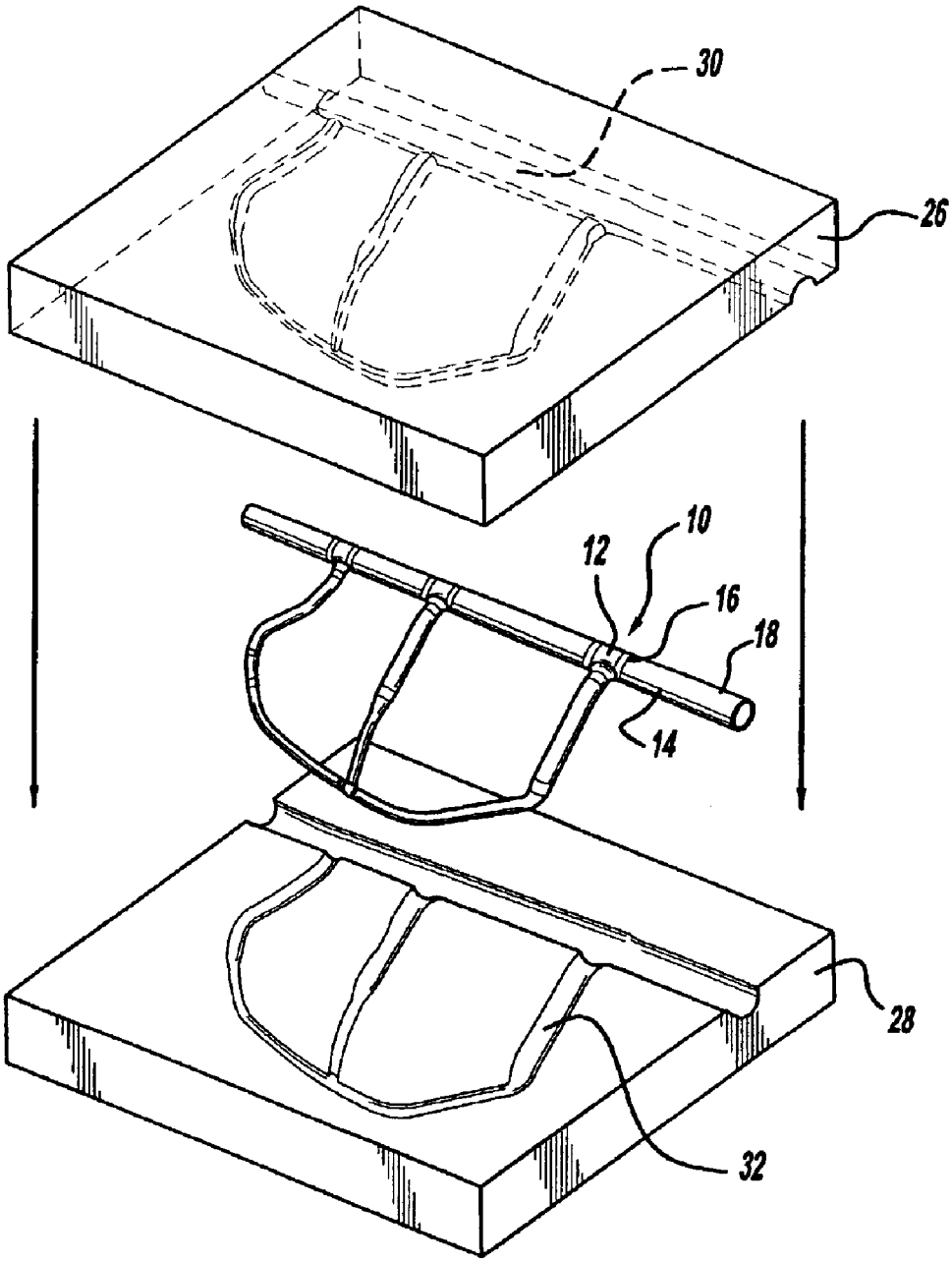
FIG. 5 is an exploded perspective view of the joined tubular members of FIGS. 2 and 4 placed between the halves of a die set.

The method also includes the step of hydroforming the joined tubular member 18. As illustrated in FIG. 5, the joined tubular member 18 may be part of a larger automotive structure or assembly. The joined tubular member 18 is placed in a die set comprised of an upper die half 26 and a lower die half 28. The upper die half 26 includes a tubular forming cavity portion 30. Likewise, the lower die half 28 includes a tubular forming cavity portion 32. It should be appreciated that a combined cross-sectional circumferential measure of the tubular forming cavity portions 30 and 32 total up to generally equal to or slightly greater than the cross-section perimeter length of the joined tubular member 18.

The ends of the joined tubular member 18 are sealed and hydraulic fluid is pumped into the joined tubular member 18 under pressure. The upper die half 26 and lower die half 28 are progressively closed so that the joined tubular member 18 is progressively deformed and the pressurized fluid captured therein expands the walls of the joined tubular member 18 into the cavity portions 30 and 32 of the die.

The die halves 26 and 28 are fully closed upon one another with the joined tubular member 18 being tightly clamped between the die halves 26 and 28, the remainder of the joined tubular member 18 having been irregularly bowed or dished inwardly. During this closing of the die halves 26 and 28, a relatively constant hydraulic pressure may be maintained within the joined tubular member 18 by incorporating a pressure relief valve (not shown) into the seal enclosing the ends of the joined tubular member 18 so that hydraulic fluid may be forced from the joined tubular member 18 as it collapses.

Once the die is closed, the joined tubular member 18 is then expanded to a final cross-sectional profile by increasing the hydraulic pressure sufficient to exceed the yield limit of the joined tubular member 18 so that the joined tubular member 18 is forced into conformity with the tubular forming cavity portions 30 and 32 of the die halves 26 and 28. The die halves 26 and 28 are then opened to permit removal of the finished tubular member from the die halves 26 and 28. The finished tubular member may be assembled into a vehicle body (not shown) or some other desired vehicle component. It should be appreciated that the die halves 26 and 28 are designed to provide the desired cross-sectional tubular shape.

Figure 3:
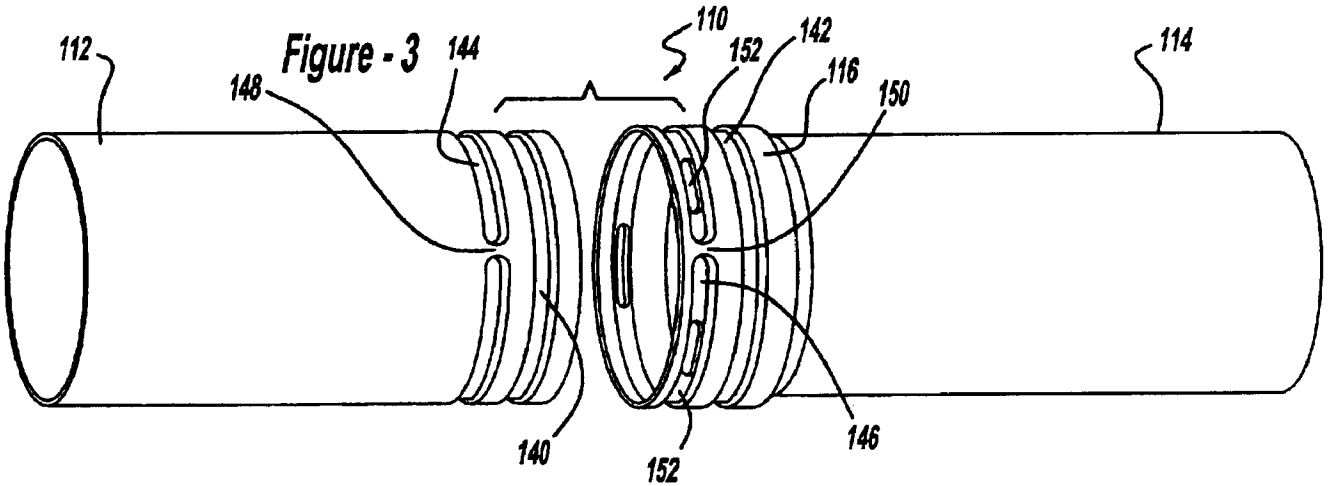
FIG. 3 is an exploded perspective view of another embodiment, according to the present invention, of a method for joining tubular members.
Figure 4:
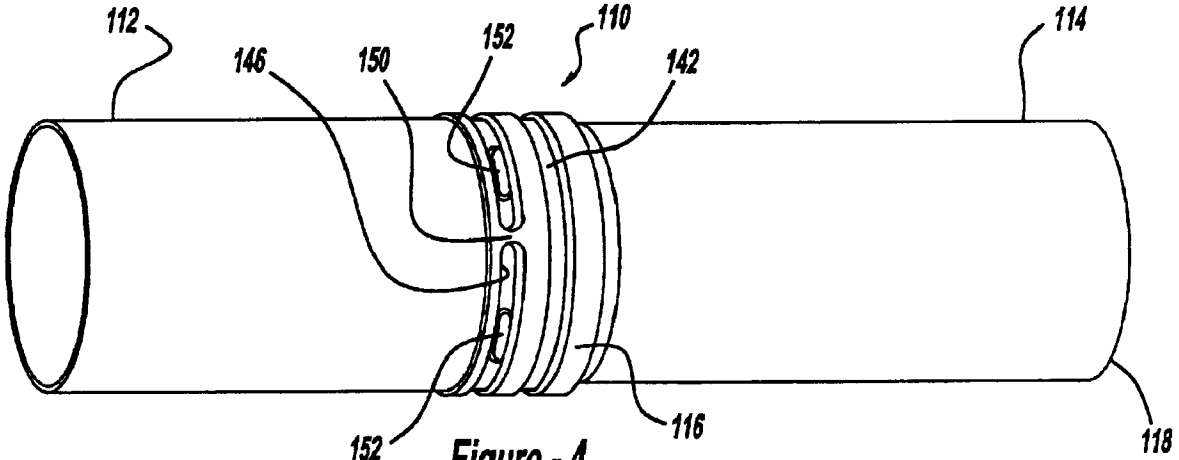
FIG. 4 is a perspective view of the joined tubular members of FIG. 3.

Referring to FIGS. 3 and 4, another embodiment, according to the present invention, of the joint 10 is shown. Like parts of the joint 10 have like reference numerals increased by one hundred (100). In this embodiment, the joint 110 includes the internal tubular member 112 and the external tubular member 114. The internal tubular member 112 has an annular and continuous first groove 140 at one end thereof. The external member 114 also has an annular and continuous first groove 142 in the flange or integral expansion or expanded region 116. It should also be appreciated that the joint 110 involves sealing and/or mechanical locking grooves or beads (multiple or singular) that are formed into the ends of the internal and external tubular members 112 and 114 in the overlap region.

In operation, the method includes the step of forming the grooves 140 and 142 into the ends of the internal tubular member 112 and the external tubular member 114 in the overlap region. The method includes the step of cooling the internal and external tubular members 112 and 114 to ambient temperature and forming a mechanical lock in the joint 110 by the grooves 140 and 142 meshing into each other.

Additionally, the joint 110 may include a plurality of, preferably two or more, grooves 144 and 146. In this embodiment, the internal tubular member 112 has an annular and discontinuous second groove 144 spaced axially from the first groove 140 at one end thereof. The second groove 144 has a stop or discontinuity 148 that provides a rotational dimensional setting feature between the internal and external tubular members 112 and 114. The external member 114 also has an annular and discontinuous second groove 146 in the flange or integral expansion or expanded region 116 spaced axially from the first groove 142. The second groove 146 has a stop or discontinuity 150 that provides a rotational dimensional setting feature between the internal and external tubular members 112 and 114. The multiple grooves 140, 142,144,146 may be formed with different unique widths for each groove so that they would mesh into similar unique width grooves on the other tubular member, thereby setting the translational relationship between internal and external tubular members 112 and 114. It should be appreciated that the grooves 140,142,144,146 can be used to set the dimensional relationship between internal and external tubular members 112 and 114 in both translational and rotational orientations.

In yet another embodiment, the joint 110 may include at least one, preferably a plurality of welding slots 152 in the external tubular member 114. Preferably, three welding slots 152 are spaced circumferentially one hundred twenty degrees (120) apart and cut into the second groove 146 in the external tubular member 114. It should be appreciated that the welding slots 152 allow the internal and external tubular members 112 and 114 to be welded by conventional processes such as MIG or TIC welding or brazed together through the slots for further strength and/or permanent joint retention. It should also be appreciated that the joint 110 could additionally be post crimped or a structural adhesive could be added to the grooves 140,142,144,146 or injected into the joint 110 for additional strength.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of joining tubular members to form a lap joint therebetween, said method comprising the steps of:

providing an internal tubular member having a first end;

providing an external tubular member having an expanded region at one end thereof;

forming an annular and discontinuous groove in the first end of the internal tubular member and in the expanded region of the external tubular member;

heating or cooling either one of die internal tubular member and the external tubular member;

joining the internal tubular member and external tubular member together by positioning the first end of the internal tubular member inside the expanded region end of the external tubular member to form an overlap region of a joined tubular member;

rotationally aligning the tubular members by meshing the discontinuous grooves in the ends of the tubular members;

positioning the joined tubular member between open die halves mating with one another to define a tubular cavity portion;

progressively closing the die halves to progressively deform the joined tabular member within the tubular cavity portion;

applying hydraulic pressure to expend and conform the joined tubular member to the tubular cavity portion;

separating the die halves; and removing the expanded joined tubular member from the die halves.

2. A method as set forth in claim 1 further comprising the step of forming an annular and continuous groove in the first end of the internal tubular member and in the expanded region of the external tubular member, prior to the heating or cooling.

3. A method as set forth in claim 2 further comprising the step of forming a mechanical lock by meshing the continuous grooves after joining the tubular members.

4. A method as set forth in claim 1 further comprising die step of cutting at least one welding slot in the discontinuous groove of the expanded region of the external tubular member.

5. A method of joining tubular members to form a lap joint therebetween, said method comprising the steps of:

providing an internal tubular member having a first end having at least one annular and continuous first groove therein and at least one annular and discontinuous second groove therein;

providing an external tabular member having an end having at least one annular and continuous third groove therein and at least one annular and discontinuous fourth groove therein;

cooling the internal tubular member or heating the external tubular member;

positioning the first end of the internal tubular member inside the end of the external tubular member to mechanically interlock the first groove with the third groove and the second groove with the fourth groove to form an overlap region and a joined tubular member;

positioning the joined tubular member between open die halves mating with one another to define a tubular cavity portion;

applying at least nominal internal hydraulic pressure to the joined tubular member;

progressively closing the die halves to progressively deform the joined tubular member within the tubular cavity portion;

increasing the hydraulic pressure to expand and conform the joined tubular member to the tubular cavity portion;

separating the die halves; and removing the joined tubular member from the die halves.

* * * * *